US009125446B2

(12) United States Patent
Wegener

(10) Patent No.: US 9,125,446 B2
(45) Date of Patent: Sep. 8, 2015

(54) HELMET WITH A CHIN STRAP BUCKLE SYSTEM

(76) Inventor: James D. Wegener, Kalispell, MO (US)

( * ) Notice: Subject to any disclaimer, the term of this patent is extended or adjusted under 35 U.S.C. 154(b) by 359 days.

(21) Appl. No.: 13/609,850

(22) Filed: Sep. 11, 2012

(65) Prior Publication Data

US 2014/0068843 A1 Mar. 13, 2014

(51) Int. Cl.

| | |
|---|---|
| ***A42B 3/08*** | (2006.01) |
| *A44B 3/08* | (2006.01) |
| *A44B 11/20* | (2006.01) |

(52) U.S. Cl.

CPC ... *A42B 3/08* (2013.01); *A44B 3/08* (2013.01); *A44B 11/20* (2013.01)

(58) Field of Classification Search

CPC ..... A44B 11/20; A44B 11/25; A42B 3/08
USPC ..... 2/421, 422, 425, 455; 24/324, 323; D11/218

See application file for complete search history.

(56) References Cited

U.S. PATENT DOCUMENTS

| | | | | | |
|---|---|---|---|---|---|
| 1,754,200 | A | * | 4/1930 | Janes | 24/324 |
| 2,039,110 | A | * | 4/1936 | Patchen | 24/324 |
| 2,061,466 | A | * | 11/1936 | Johnson | 24/324 |
| 2,867,811 | A | * | 1/1959 | Jones | 2/421 |
| 3,065,747 | A | | 11/1962 | Forkel | |
| 3,531,955 | A | | 10/1970 | Taylor et al. | |
| 3,538,554 | A | * | 11/1970 | Ford | 24/324 |
| 3,815,152 | A | | 6/1974 | Bednarczuk et al. | |
| 3,925,822 | A | | 12/1975 | Sawyer | |
| 4,279,037 | A | | 7/1981 | Morgan | |
| 4,903,349 | A | | 2/1990 | Arai | |
| 5,077,839 | A | | 1/1992 | Keller | |
| 5,259,096 | A | | 11/1993 | Grant | |
| 5,774,900 | A | | 7/1998 | Wu et al. | |
| 5,915,538 | A | | 6/1999 | Basson et al. | |
| 5,946,735 | A | | 9/1999 | Bayes | |
| 6,003,156 | A | | 12/1999 | Anderson | |
| 6,254,302 | B1 | * | 7/2001 | Kraus | 403/326 |
| D486,093 | S | | 2/2004 | Tobergte | |
| 2007/0193006 | A1 | | 8/2007 | Kitano et al. | |
| 2010/0319701 | A1 | | 12/2010 | Connell | |

FOREIGN PATENT DOCUMENTS

| | | |
|---|---|---|
| ST | 9423606 | 10/1994 |
| ST | 2012028742 | 3/2012 |

* cited by examiner

*Primary Examiner* — Danny Worrell
*Assistant Examiner* — Khaled Annis
(74) *Attorney, Agent, or Firm* — JP Webb; Jason P. Webb; Danny Y. H. Cheng

(57) ABSTRACT

A helmet including a protective head covering and a chin strap. The helmet includes an anchor protruding from the protective head covering and including an enlarged anchor head. The helmet includes a buckle coupled to the chin strap, and selectably coupleable to the anchor. The buckle includes a housing including a pair of strap slits. The buckle includes a cavity disposed in the housing and sized to contain the enlarged anchor head. The buckle includes a retaining slot having a retaining region sized to securely couple to the enlarged anchor head. The helmet includes a securement member disposed about the retaining slot. The helmet includes a second anchor and a second buckle; wherein the second anchor and the second buckle minor the anchor and the buckle disposed on the second side region of the protective head covering.

16 Claims, 8 Drawing Sheets

HELMET WITH A CHIN STRAP BUCKLE SYSTEM

BACKGROUND OF THE INVENTION

1. Field of the Invention

The present invention relates to safety devices, specifically to a helmet having a safety buckle system.

2. Description of the Related Art

A helmet is a form of protective gear worn on the head to protect it from injuries. All helmets attempt to protect the user's head by absorbing mechanical energy and protecting against penetration. Their structure and protective capacity are altered in high-energy impacts. Beside their energy-absorption capability, their volume and weight are also important issues, since higher volume and weight increase the injury risk for the user's head and neck. Anatomical helmets adapted to the inner head structure were invented by neurosurgeons at the end of the 20th century.

Helmets used for different purposes have different designs. For example, a bicycle helmet must protect against blunt impact forces from the wearer's head striking the road. A helmet designed for rock climbing must protect against heavy impact, and against objects such as small rocks and climbing equipment falling from above. Practical concerns also dictate helmet design: a bicycling helmet should be aerodynamic in shape and well ventilated, while a rock climbing helmet must be lightweight and small so that it does not interfere with climbing.

In addition, a football helmet is a protective device used primarily in American football and Canadian football. It consists of a hard plastic top with thick padding on the inside, a face mask made of one or more rubber coated metal bars, and a chinstrap. Some players add polycarbonate visors to their helmets, which are used to protect eyes from glare and impacts. Helmets are a requirement at all levels of organized football, except for non-tackle variations such as flag football. Although they are protective, players can and do still suffer head injuries such as a concussion. Each position has a different type of face mask to balance protection and visibility.

Some improvements have been made in the field. Examples of references related to the present invention are described below in their own words, and the supporting teachings of each reference are incorporated by reference herein:

U.S. Pat. No. 6,003,156, issued to Anderson, discloses a Safety Helmet Lockout System comprised of a safety helmet with a uniquely keyed system contained within its cranial webbing and chinstrap that has the ability to sense when said helmet is securely strapped upon the wearers head. The chinstrap contains a locking buckle which releases a uniquely keyed enabling key and/or a signal upon sensing that said safety helmet is securely strapped upon the wearers head. Several means of sensing are possible, but the preferred embodiment employs physio sensors located within the cranial webbing and chinstrap of said safety helmet. The locking buckle which is located on the chinstrap, releases said enabling key or signal after receiving signals from all the physio sensors, and sensing tension in the chinstrap. The released enabling key, or emitted signal, can then be used to access vehicles, sporting goods, industrial equipment, tools, passage locks, and the like. The access locks can range from simple ignition locks and passage locks, to retracting pin or keyed brake systems, keyed clutch systems, and specialty lockout systems for certain applications (such as, but not limited to, skiis, snowboards, and snowmobiles).

U.S. Pat. No. 5,946,735, issued to Bayes, discloses a quick-release football helmet chin strap that incorporates the use of a hook and loop fastener to tighten the strap and secure the helmet to the player's head. Intended for use on newly produced helmets and replacing the snap-type fasteners on existing helmets, the use of the hook and loop fasteners eliminates the burden associated with using the snap fasteners during the frequent between-play attachment and detachment.

U.S. Pat. No. 4,279,037, issued to Morgan, discloses an adjustable suspension for protective headgear wherein a constantly uniform tension on all securing members of the suspension can be simultaneously increased or decreased uniformly through a one-step tension control device without removing the headgear from the wearer's head. A chin-strapless embodiment which anchors against vertical displacement on the forehead and skull base. Detachable chin strap with concealed dual locking fastener. A headgear wherein the protective elements are supported by an adjustable, detachable suspension.

U.S. Patent Application Publication No.: 2010/0319701, by Connell, discloses a respirator assembly has a respirator mask and a separate bracing device. The bracing device has a pressure element mountable over a frontpiece of the respirator mask, which bears against that frontpiece to hold the respirator mask against the face of a user. The bracing device also has two connection portions, each having one end attached to the pressure element and the other end being for attaching the bracing device to a helmet worn by the user. The connection portions are extendable. Thus, shortening or distending the connection portions reduces the distance between the helmet and the respirator mask and thereby causes the pressure element to bear against the frontpiece of the respirator mask, compressing the user's head between the helmet and the mask and thereby holding the mask against the user's face.

The inventions heretofore known suffer from a number of disadvantages which include being unsafe, being unable to securely couple a helmet to a wearer, being difficult to use, being uncomfortable, being unable to securely couple a chin strap to a helmet; being easily removed; being easily knocked off; coming unsnapped on impact; coming uncoupled when pressure is applied on the strap in a forward direction; being difficult to detach; and the like.

What is needed is a helmet that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available helmets. Accordingly, the present invention has been developed to provide a helmet including a safety buckle system configured to securely couple a helmet to a wearer.

According to one embodiment of the invention, there is a helmet that may include a protective head covering. The protective head covering may have a first side region and a second side region. The first side region may be disposed opposite of second side region. The helmet may include a chin strap that may be coupled to the first side region of the protective head covering and may be extending across a front region of the protective head covering. The helmet may include an anchor that may be protruding from the second side region of the protective head covering and may include an enlarged anchor head.

The helmet may include a buckle that may be coupled to the chin strap, and may be selectably coupleable to the anchor. The buckle may include a housing that may have a pair of strap slits. The pair of slits may each include a set of gripping teeth that may be disposed on a side of the slit. The set of gripping teeth of the pair of slits may be oriented so as to be facing oppositely from each other. The housing may includes a first end and a second end each may be extending from the housing at an angle and may be configured to assist in coupling and removing of the buckle from the anchor. The pair of slits may be disposed about the first end and the second end.

The housing may include a cavity that may be disposed in the housing and may be sized to contain the enlarged anchor head. The housing may also include a retaining slot that may be disposed through the housing and may include a retaining region that may be sized to securely couple to the enlarged anchor head. The retaining slot may include a receiving region that may be in functional communication with the retaining region and may be sized larger than the enlarged anchor head. The receiving region may be disposed at a position closer to the front region of the helmet than the retaining region when the buckle is coupled to the anchor. The retaining region may be sized and shaped substantially smaller than the anchor. The helmet may include a securement member that may be disposed about the retaining slot and may be configured to be disposed over the anchor when the buckle is coupled thereto. The helmet may further include a second anchor and a second buckle that may be disposed on the first side region and may be configured to couple together.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
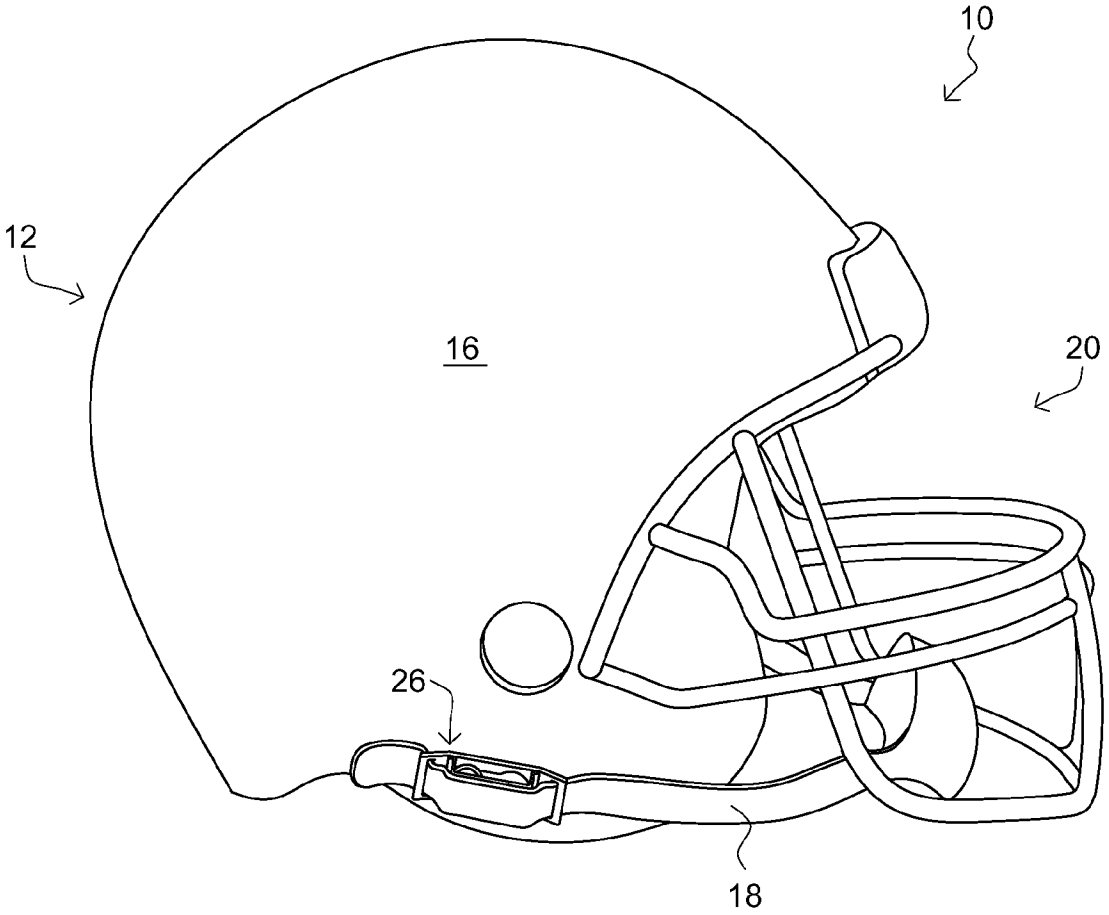
FIG. 1 is a side elevational view of a helmet with a buckle coupled to an anchor, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a side elevational view of a helmet, according to one embodiment of the invention. There is shown a helmet 10 including a protective head covering 12 having a second side region 16 and a chin strap 18 coupled thereto by a buckle coupled to an anchor.

The illustrated helmet 10 is configured to protect a head of a player or wearer during physical contact with other players or wearers. The illustrated helmet 10 is a football helmet configured to protect a head of a football player playing American football. The helmet 10 may vary in size, shape, design, configuration, length, height, width, etc. and still perform its intended function.

The helmet 10 includes a protective head covering 12 configured to protect ahead of a wearer. The protective head covering 12 is configured to completely cover a head ofa. wearer. The protective head covering 12 includes a first side region 14 and a second side region 16. The helmet 10 includes a chin strap 18 coupled to a first side region of the protective head covering 12 extending across a front region 20 of the protective head covering 12. The chin strap 18 is selectably coupleable to the second side region 16 of the protective head covering 12.

The helmet 10 includes a buckle 26 coupled to the chin strap 18, and is selectably coupleable to an anchor disposed on the second side region 16 of the protective head covering 12. The buckle 26 includes a housing coupled to the chin strap 18 and configured to securely couple the chin strap 18 to the protective head covering 12, and thereby securely coupling the helmet 10 to a wearer's head.

In operation, a user pulls the chin strap across the front of their face while their head is disposed within the helmet. The buckle attached near and end of the chin strap is pulled so that its aperture may fit over the top of the anchor coupled to the helmet. Generally, this position will be slightly tighter for the user than desired during use of the helmet, but is quickly reduced because once the anchor is disposed through the aperture, the buckle then is able to slide forward to a locked position wherein the anchor is wedged in place within a slot that is sized smaller than the aperture. The buckle also includes structure that prevents the anchor and buckle from substantially moving in relation to each other (other than minor rotation of the buckle about the anchor, wherein the anchor and buckle are shaped to permit the same) while the anchor is locked/wedged in a locked configuration.

In one non-limiting example, there is a buckle system of a helmet which operates by sliding a buckle onto an anchor coupled to a helmet which prevents the chin strap from being unbuckled during play. It also provides the ease of removal when the player is ready to take his/her helmet off. There is a strap that is connected to a helmet at one end and a sliding buckle at the other. The sliding buckle connects to an anchor placed generally where typical helmets would include a snap. The anchor is generally screwed to the helmet, or otherwise securely fastened thereto and/or extending therefrom. The snap has an extra lip that operates to hold the buckle in place by a grommet on the buckle. The buckle includes strap apertures that have two sets of teeth are pointed in the opposite direction in order to secure the buckle in both directions along the body of the strap.

When the user desires to remove the helmet, the chin strap may be pulled tight again to cause the anchor and buckle to slide in relation to one another such that the anchor may exit the aperture. Once the anchor exits the aperture, the user may pull the chin strap away from the face and then remove the helmet.

Advantageously, the helmet with the improved buckle helps to prevent head injuries that are caused when chin straps unsnap, thus allowing the helmet to be dislodged from the player while playing the game. However, it still allows for easy removal of the helmet and generates a self-tightening structure, such that the typical forces applied against the buckle/anchor during play will tend to enhance the coupling instead of tending to dislodge the coupling.

In one non-limiting example, there may be two buckles on a chin strap that each couple to the helmet at opposite sides to opposite anchors, respectively coupled to and/or extending from opposite sides of the helmet. In such an example, FIGS. 1 and 2 would illustrate a helmet and the unseen side of each would simply be a minor image of what is shown.

Figure 2:
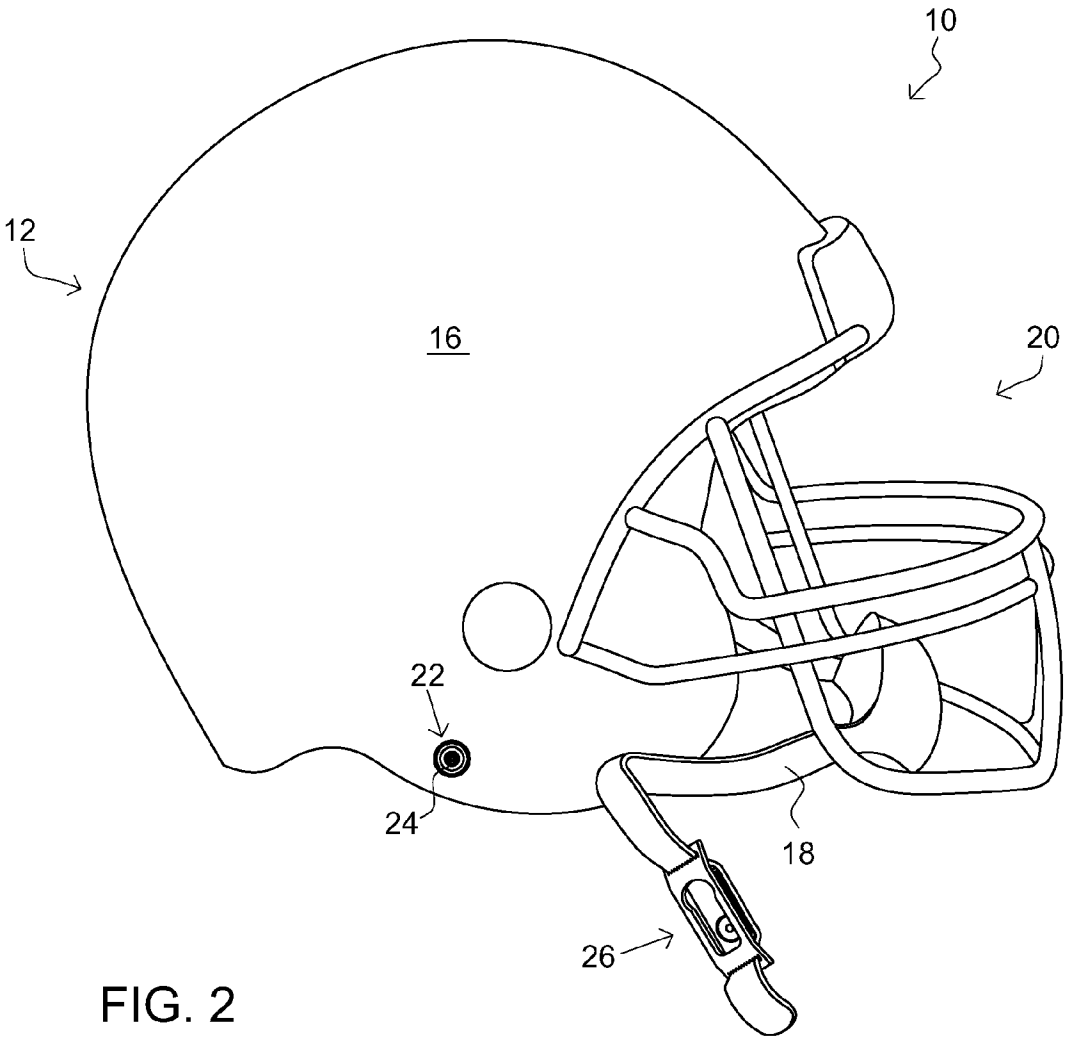
FIG. 2 is a side elevational view of a helmet with a buckle detached from an anchor, according to one embodiment of the invention.

FIG. 2 is a side elevational view of a helmet, according to one embodiment of the invention. There is shown a helmet 10 including a protective head covering 12 having a second side region 16, a chin strap 18, an anchor 22, and a buckle 26. In this illustration, the buckle and anchor are uncoupled.

The helmet 10 includes a protective head covering 12 configured to protect a head of a wearer. The protective head covering 12 is configured to completely cover a head of a wearer. The protective head covering 12 includes a first side region and a second side region 16. The helmet 10 includes a chin strap 18 coupled to a first side region of the protective head covering 12 extending across a front region 20 of the protective head covering 12. The chin strap 18 is selectably coupleable to the second side region 16 of the protective head covering 12.

The helmet 10 includes a buckle 26 coupled to the chin strap 18, and is selectably coupleable to an anchor 22 disposed on the second side region 16 of the protective head covering 12. The illustrated anchor 22 protrudes from the second side region 16 of the protective head covering 12. The illustrated anchor 22 includes an enlarged anchor head 24. The buckle 26 includes a housing coupled to the chin strap 18 and configured to securely couple about the enlarged anchor head 24, thereby securely coupling the chin strap 18 to the protective head covering 12, and thereby securely coupling the helmet 10 to a wearer's head.

Figure 3:
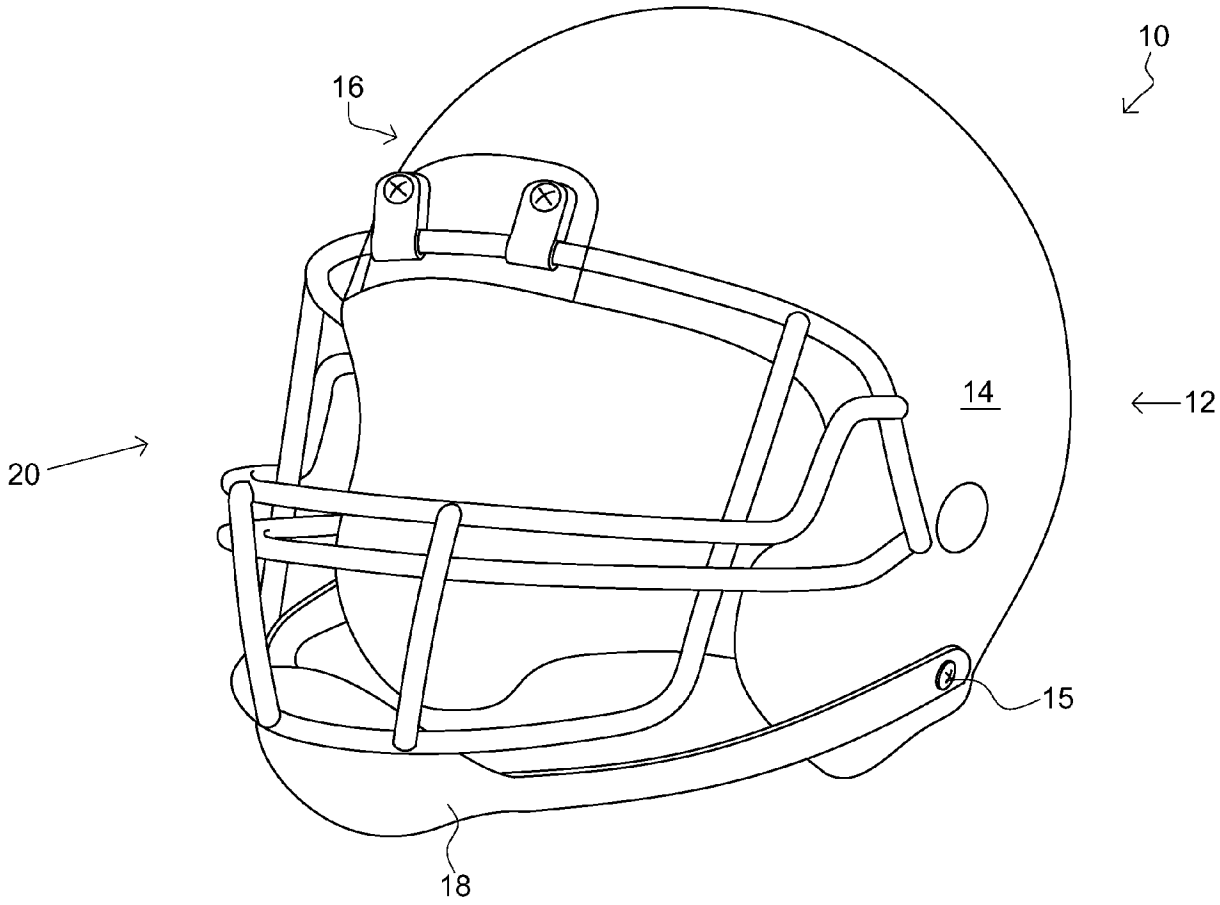
FIG. 3 is a perspective view of a helmet with a strap securely coupled thereto, according to one embodiment of the invention.

FIG. 3 is a perspective view of a helmet, according to one embodiment of the invention. There is shown a helmet 10 including a protective head covering 12 having a first side region 14, a second side region 16, a chin strap 18, and a rivet 15.

The helmet 10 includes a protective head covering 12 configured to protect a head of a wearer. The protective head covering 12 is configured to completely cover a head of a wearer. The protective head covering 12 includes a first side region 14 and a second side region 16. The helmet 10 includes a chin strap 18 coupled to a first side region 14 of the protective head covering 12 extending across a front region 20 of the protective head covering 12 and selectably coupling to the second side region 16 of the protective head covering 12. The illustrated chin strap 18 is riveted to the first side region 14 of the protective head covering 12 by a rivet 15, thereby permanently coupling the chin strap 18 to the first side region 14 of the protective head covering 12 of the helmet 10.

Figure 4:
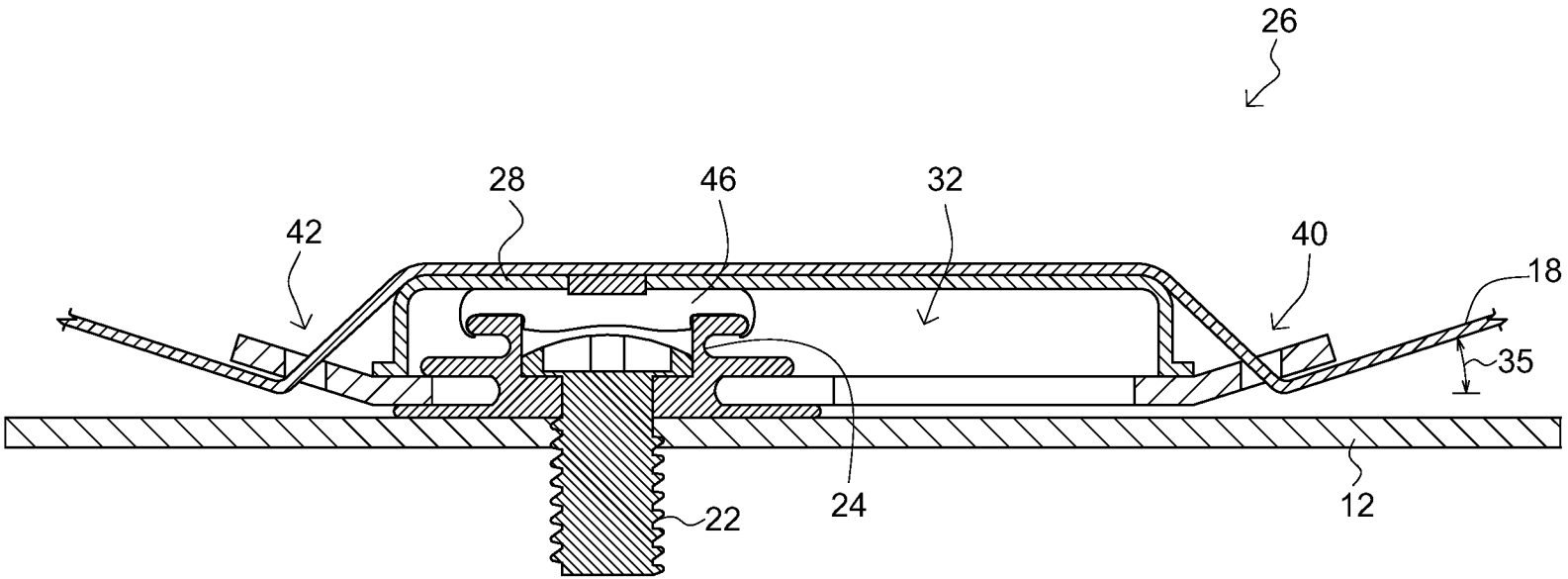
FIG. 4 is a side cross-sectional view of a buckle coupled to an anchor of a helmet, according to one embodiment of the invention.

FIG. 4 is a side cross-sectional view of a buckle coupled to an anchor of a helmet. according to one embodiment of the invention. There is shown a buckle 26 coupled to a chin strap 18 and an anchor 22 of a protective head covering 12. The buckle includes a housing 28 having a first end 40 and a second 40, a cavity 32, and a securement member 46.

The illustrated buckle 26 is coupled to a chin strap 18 and to an enlarged anchor head 24 of an anchor 22. The anchor 22 is coupled to a protective head covering 12. The buckle is sized and shaped to receive and securely couple to the anchor 22. The buckle 26 includes a housing 28 having a first end 40 and a second end 42 each extending from the housing 28 at an angle 35 and configured to assist in coupling and removing of the buckle 26 from the anchor 22. It may be that the angle of deflection of the first and second ends may be between two or more of about 5, 7, 10, 12, 15, 17, 20, 25, and 30 degrees from the plane of the housing. It may be that the angle of deflection of the first and second ends is between about 15 to about 20 degrees from the plane of the housing. The angle of deflection may be selected to reduce a frictional surface area between the strap and the helmet. The first and second ends may include one or more indentations or other inset structures to provide extra spacing for the strap to prevent and/or reduce wear of the strap by rubbing against the helmet and/or to otherwise limit undesired interaction therebetween while still permitting the housing to securely couple to the strap in a manner that limits the lateral motion of the strap with respect to the housing while in use. The housing 28 includes a cavity 32 disposed in the housing 28 and is sized to contain the enlarged anchor head 24.

The illustrated housing 28 includes a securement member 46 disposed about the housing 28, and is configured to be disposed over the enlarged anchor head 24 of the anchor 22. The securement member 46 may include a magnetic layer configured to magnetically couple to the enlarged anchor head 24. The securement member 46 may include a rubber material configured to securely rest about the enlarged anchor head 24. The securement member 46 may include a flexible, compressible and/or elastic material that may be sized to press against the anchor head when the anchor head is slid into a locked configuration within the housing. The illustrated securement member 46 is shaped to match a front surface of the anchor head such that it provides support thereto and prevents the same from shifting, tilting, and/or otherwise moving in a manner that is undesired while the user plays.

Figure 5:
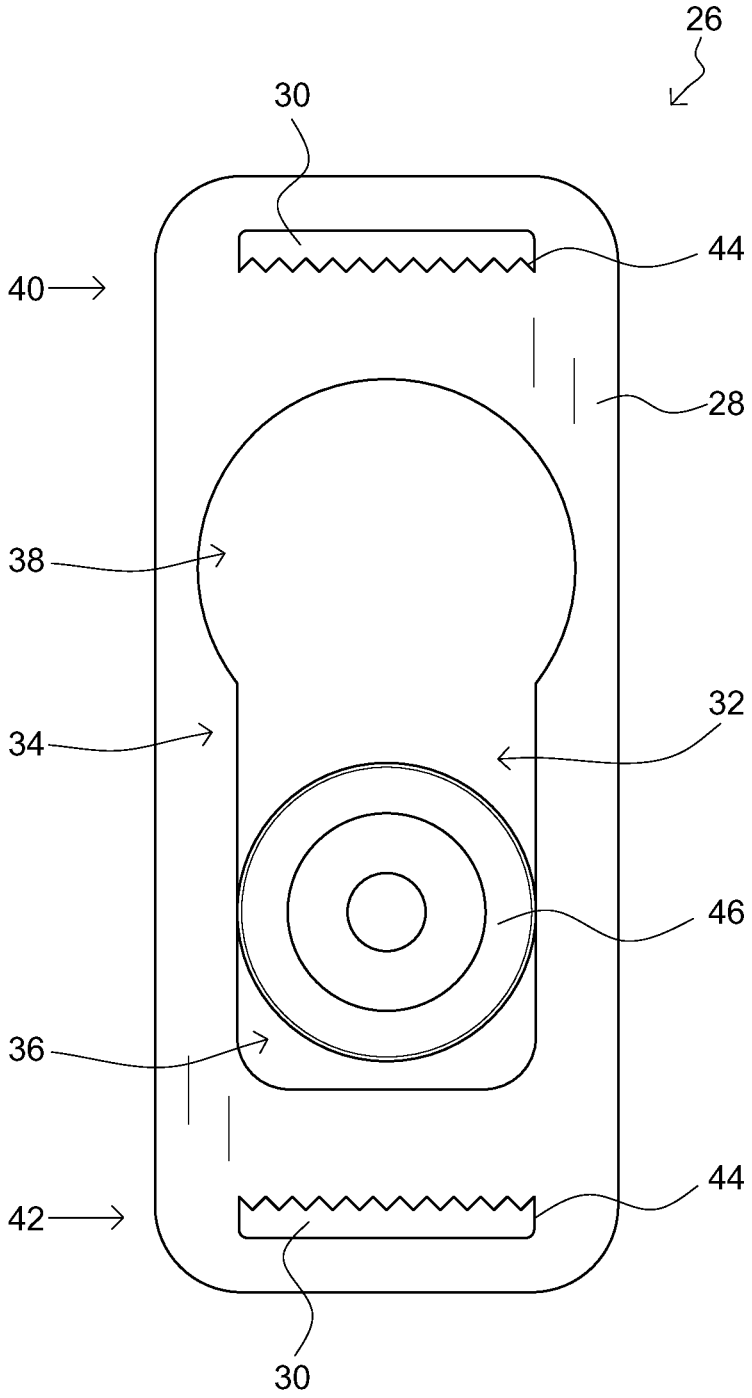
FIG. 5 is a top plan view of a buckle, according to one embodiment of the invention.

FIG. 5 is a top plan view of a buckle, according to one embodiment of the invention. There is shown a buckle 26 including a housing 28 having a pair of strap slits 30, a cavity 32, a retaining slot 34, and a securement member 46.

The illustrated buckle 26 is configured to be coupled to a chin strap and a protective head covering of a helmet. The buckle 26 is configured to be selectably coupleable to an enlarged anchor head of an anchor coupled to a protective head covering of a helmet. The buckle 26 includes a housing 28 having a pair of strap slits 30. The pair of strap slits 30 each include a set of gripping teeth 44 that are disposed on one side of the strap slit 30. The set of gripping teeth 44 of the pair of strap slits 30 are oriented so as to be facing oppositely from each other. The housing 28 includes a first end 40 and a second end 42 each extending from the housing 28 at an angle configured to assist in coupling and removing of the buckle 26 from an anchor. The pair of strap slits 30 are disposed about the first end 40 and the second end 42.

The housing 28 includes a cavity 32 disposed in the housing 28 and sized and shaped to contain/trap an enlarged anchor head of an anchor. The housing 28 includes a retaining slot (e.g. the illustrated keyhole-shaped retaining channel) 34 disposed through the housing 26 configured to receive an enlarged anchor head of an anchor. The retaining slot 34 includes a retaining region 26 sized and shaped to securely couple to an enlarged anchor head of an anchor, thereby selectably trapping the enlarged anchor head therein as illustrated when the enlarged anchor head is disposed within the retaining region of the channel which is at a body portion of the illustrated keyhole-shaped retaining channel. The retaining slot 34 includes a receiving region 38 that is disposed at a head of the illustrated key-hole shaped retaining channel in functional communication with the retaining region 26 and sized and shaped larger than an enlarged anchor head of an anchor. The receiving region 38 is disposed at a position closer to a front region of a helmet than the retaining region 38 when the buckle 26 is coupled to an enlarged anchor head of an anchor. The retaining region 36 is sized and shaped slightly smaller than an enlarged anchor head of an anchor. The housing includes a securement member 46 disposed about the retaining slot 34 and is configured to be disposed over an enlarged anchor head of an anchor when the buckle 26 is coupled thereto.

Figure 6:
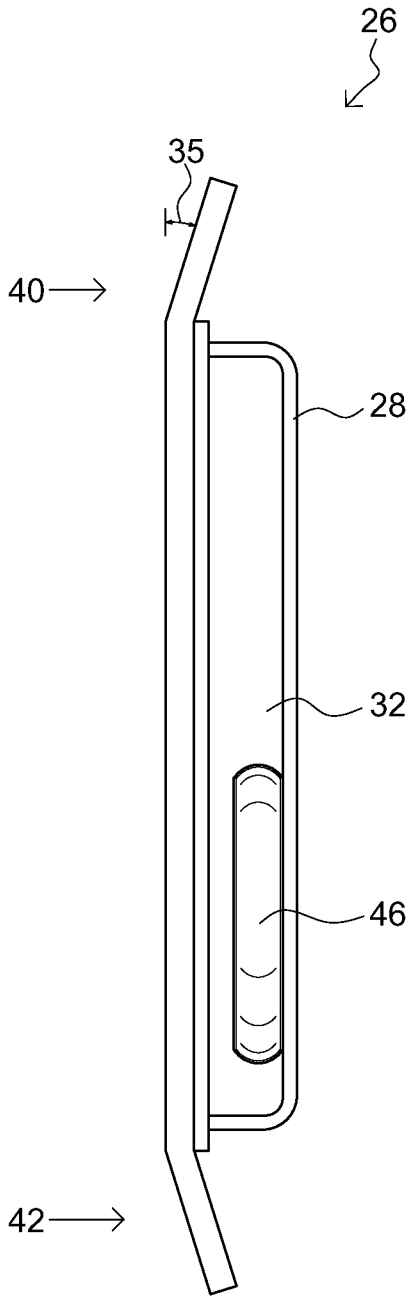
FIG. 6 is a side elevational view of a buckle, according to one embodiment of the invention.

FIG. 6 is a side elevational view of a buckle, according to one embodiment of the invention. There is shown a buckle 26 including a housing 28 having a first end 40 and a second end 42, a cavity, and a securement member 46.

The illustrated buckle 26 is configured to be coupled to a chin strap and a protective head covering of a helmet. The buckle 26 is configured to be selectably coupleable to an enlarged anchor head of an anchor which is coupled to a protective head covering of a helmet. The buckle 26 includes a housing 28 having a first end 40 and a second end 42 each extending from the housing 28 at an angle 35. The angled configuration of the first end 40 and the second end 42 are configured to assist in coupling of the buckle 26 to an enlarged anchor head of an anchor; and to the removing of the buckle 26 from an enlarged anchor head of an anchor.

The housing 28 includes a cavity 32 disposed in the housing 28 and sized and shaped to contain an enlarged anchor head of an anchor. The housing 28 includes a securement member 46 disposed about the cavity 32 and is configured to be disposed over an enlarged anchor head of an anchor when the buckle 26 is coupled thereto, thereby securely coupling the housing 28 to an enlarged anchor head of an anchor.

Figure 7:
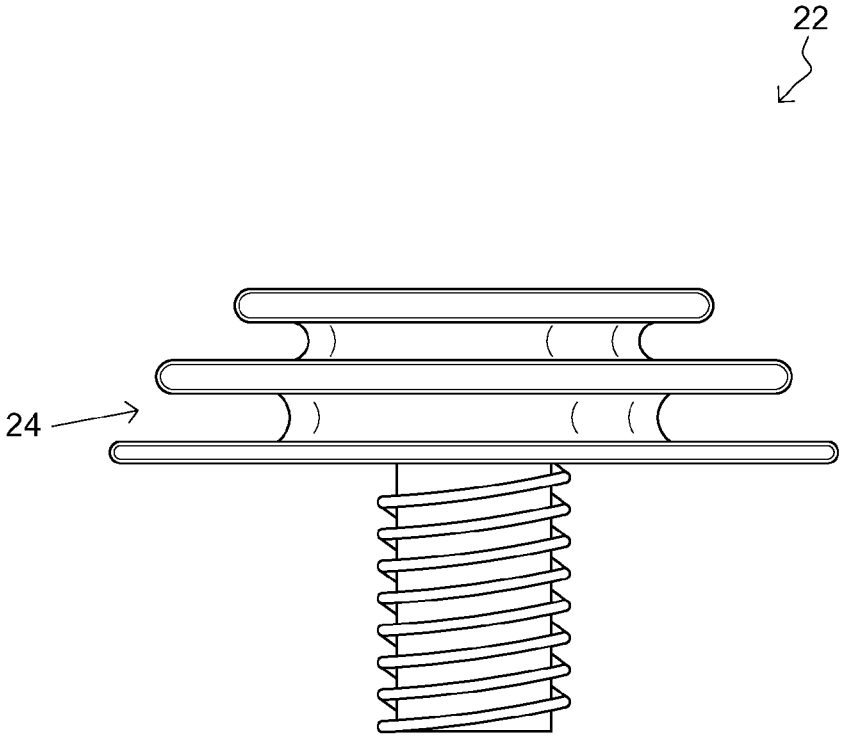
FIG. 7 is side elevational view of an anchor, according to one embodiment of the invention.
Figure 8:
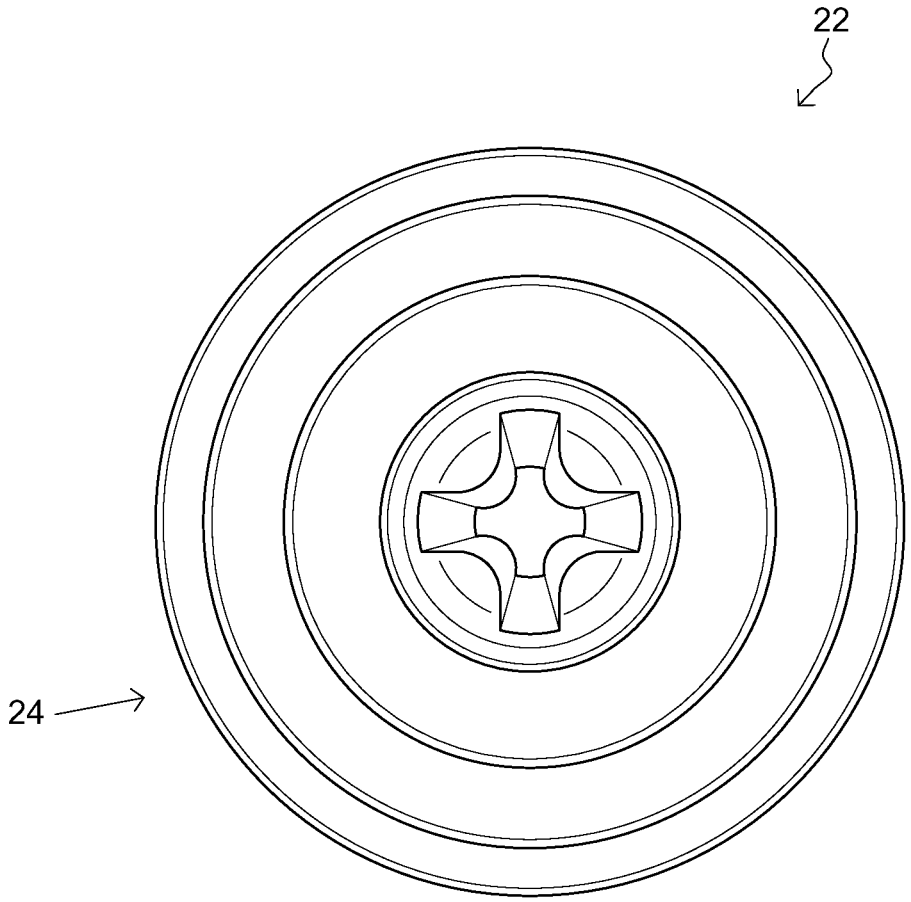
FIG. 8 is a top plan view of an anchor, according to one embodiment of the invention.

FIG. 7 is side elevational view of an anchor and FIG. 8 is a top plan view of an anchor, according to one embodiment of the invention. There is shown an anchor 22 including an enlarged anchor head 24.

The illustrated anchor 22 is configured to be protruding from a second side region of a protective head covering of a helmet. The anchor 22 includes an enlarged anchor head 24 configured to selectably couple to a buckle of a chin strap. The enlarged anchor head 24 is configured to be disposed within a cavity of a buckle and slide from a receiving region of a retaining slot of a buckle down to a retaining region of a buckle, thereby securing a chin strap to the enlarged anchor head 24. The configuration of the enlarged anchor head of the anchor and a buckle is designed to restrict detachment of the chin strap and thereby the helmet from a wearer's head. The enlarged anchor head 24 and the buckle is designed to enable removal of a chin strap by pulling the chin strap up, thereby disposing the enlarged anchor head from a retaining region into a receiving region of the buckle, thereby enabling a wearer to remove the buckle from the anchor, and thereby also the helmet.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the anchor is illustrated as having a circular face and circular flange shape, other non-circular shapes are possible and may be used in combination with buckle apertures and slots of shapes that may be circular/ rectangular as illustrated or may be otherwise shaped to match and provide the functionality described herein.

Additionally, although the figures illustrate rivets, screws, and similar methods of securely fastening objects together, it is understood that there are a great variety of methods of securely coupling structures together and that such "permanent" coupling structures/devices and the like a plethoric and for purposes of this invention are all contemplated as being able to be used herein.

It is expected that there could be numerous variations of the design of this invention. An example is that the exact illustrated buckle teeth may vary a great deal in shape, size, number and exact location while still falling within the bounds of the description of the various embodiments described herein.

Finally, it is envisioned that the components of the device may be constructed of a variety of materials, including but not limited to metal, ceramic, rubber, plastic, Teflon, woven fibers, natural fibers, artificial fibers, resins, composites thereof and the like.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A helmet, comprising:

a) a protective head covering having a first side region and a second side region; wherein the first side region is disposed opposite of the second side region;

b) a chin strap coupled to the first side region of the protective head covering and extending across a front region of the protective head covering;

c) an anchor protruding from the second side region of the protective head covering and including an enlarged anchor head; and d) a buckle coupled to the chin strap, and selectably coupleable to the anchor, including:

d1) a housing including a pair of strap slits; wherein the pair of strap slits are configured to couple to the chin strap;

d2) a cavity disposed in the housing and sized to contain the enlarged anchor head; and d3) a keyhole-shaped retaining channel disposed through the housing and including a retaining region at a body of the key-hole-shaped retaining channel sized to securely couple to the enlarged anchor head and a receiving region at a head of the key-hole-shaped retaining channel in functional communication with the retaining region and sized larger than the enlarged anchor head, wherein the receiving region is disposed at a position closer to the front region of the protective head covering than the retaining region when the buckle is coupled to the anchor, such that the retaining region traps the enlarged anchor head when disposed therein.

2. The helmet of claim 1, wherein the housing includes a first end and a second end each extending from the housing at an angle and configured to assist in coupling and removing of the buckle from the anchor.

3. The helmet of claim 2, wherein the pair of strap slits are disposed about the first end and the second end of the housing.

4. The helmet of claim 1, wherein the retaining region is sized and shaped substantially smaller than the anchor.

5. The helmet of claim 1, wherein the pair of strap slits each include a set of gripping teeth disposed on a side of the strap slit.

6. The helmet of claim 5, wherein the set of gripping teeth of the pair of strap slits are oriented so as to be facing oppositely from each other.

7. The helmet of claim 1, further comprising a securement member disposed about the keyhole-shaped retaining channel and is configured to be disposed over the anchor when the buckle is coupled thereto.

8. The helmet of claim 1, further comprising a second anchor and a second buckle disposed on the first side region and configured to couple together; wherein the second anchor and the second buckle mirror the anchor and buckle disposed on the second side region of the protective head covering.

9. A helmet, comprising:

a) a protective head covering having a first side region and a second side region; wherein the first side region is disposed opposite of the second side region;

b) a chin strap coupled to the first side region of the protective head covering and extending across a front region of the protective head covering;

c) an anchor protruding from the second side region of the protective head covering and including an enlarged anchor head; and d) a buckle coupled to the chin strap, and selectably coupleable to the anchor, including:

d1) a housing including a pair of strap slits; wherein the pair of strap slits are configured to couple to the chin strap; wherein the pair of strap slits each include a set of gripping teeth disposed on a side of the strap slit;

d2) a cavity disposed in the housing and sized to contain the enlarged anchor head; and d3) a keyhole-shaped retaining channel disposed through the housing and including a retaining region at a body of the keyhole-shaped retaining channel sized to securely couple to the enlarged anchor head and a receiving region at a head of the keyhole-shaped retaining channel in functional communication with the retaining region and sized larger than the enlarged anchor head, wherein the receiving region is disposed at a position closer to the front region of the protective head covering than the retaining region when the buckle is coupled to the anchor.

10. The helmet of claim 9, wherein the housing includes a first end and a second end each extending from the housing at an angle and configured to assist in coupling and removing of the buckle from the anchor.

11. The helmet of claim 10, wherein the pair of strap slits are disposed about the first end and the second end of the housing.

12. The helmet of claim 11, wherein the retaining region is sized and shaped substantially smaller than the anchor.

13. The helmet of claim 12, wherein the set of gripping teeth of the pair of slits are oriented so as to be facing oppositely from each other.

14. The helmet of claim 13, further comprising a securement member disposed about the keyhole-shaped retaining channel and is configured to be disposed over the anchor when the buckle is coupled thereto.

15. The helmet of claim 14, further comprising a second anchor and a second buckle disposed on the first side region and configured to couple together; wherein the second anchor and the second buckle mirror the anchor and the buckle disposed on the second side region of the protective head covering.

16. A helmet, comprising:

a) a protective head covering having a first side region and a second side region; wherein the first side region is disposed opposite of the second side region;

b) a chin strap coupled to the first side region of the protective head covering and extending across a front region of the protective head covering;

c) an anchor protruding from the second side region of the protective head covering and including an enlarged anchor head;

d) a buckle coupled to the chin strap, and selectably coupleable to the anchor, including:

d1) a housing including a pair of strap slits; wherein the pair of strap slits are configured to couple to the chin strap; wherein the pair of strap slits each include a set of gripping teeth disposed on a side of the strap slit; wherein the set of gripping teeth of the pair of strap slits are oriented so as to be facing oppositely from each other; wherein the housing includes a first end and a second end each extending from the housing at an angle and configured to assist in coupling and removing of the buckle from the anchor; wherein the pair of strap slits are disposed about the first end and the second end of the housing;

d2) a cavity disposed in the housing and sized to contain the enlarged anchor head; and d3) a keyhole-shaped retaining channel disposed through the housing, shaped to selectably trap the enlarged anchor head therein, and therefore including a retaining region sized to securely couple to the enlarged anchor head and a receiving region in functional communication with the retaining region and sized larger than the enlarged anchor head, wherein the receiving region is disposed at a position closer to the front region of the protective head covering than the retaining region when the buckle is coupled to the anchor; wherein the retaining region is sized and shaped substantially smaller than the anchor;

e) a securement member disposed about the keyhole-shaped retaining channel and is configured to be disposed over the anchor when the buckle is coupled thereto; and f) a second anchor and a second buckle disposed on the first side region and configured to couple together; wherein the second anchor and the second buckle mirror the anchor and the buckle disposed on the second side region of the protective head covering.

* * * * *